United States Patent [19]

Tassoni

[11] Patent Number: 4,615,146

[45] Date of Patent: Oct. 7, 1986

[54] SMOOTHING MACHINE FOR WOOD PANELS

[75] Inventor: Vittorio Tassoni, Imola, Italy

[73] Assignee: D.M.C. Divisione Meccanica Castelli S.p.A., Bologna, Italy

[21] Appl. No.: 654,262

[22] Filed: Sep. 25, 1984

[30] Foreign Application Priority Data

Oct. 27, 1983 [IT] Italy ..... 23485 A/83

[51] Int. Cl.[4] ..... B24B 7/06

[52] U.S. Cl. ..... 51/90; 51/76 R; 51/273; 15/21 D; 15/77

[58] Field of Search ..... 51/76 R, 90, 273; 15/21 D, 77; 144/115, 117 R, 117 C

[56] References Cited

U.S. PATENT DOCUMENTS

| | | | |
|---|---|---|---|
| 753,911 | 3/1904 | Pelstring | 51/90 |
| 1,011,991 | 12/1911 | Moser | 51/90 |
| 2,420,876 | 5/1947 | Freud | 51/90 |
| 2,617,223 | 11/1952 | McElroy et al. | 51/76 R |
| 3,271,909 | 9/1966 | Rutt et al. | 51/76 R X |
| 3,435,566 | 4/1969 | Enserink | 51/76 R X |
| 4,328,645 | 5/1982 | Sauer | 51/273 X |
| 4,361,987 | 12/1982 | Lapsker | 51/90 |

FOREIGN PATENT DOCUMENTS

| | | | |
|---|---|---|---|
| 497412 | 3/1937 | United Kingdom | 51/90 |

*Primary Examiner*—Robert P. Olszewski

*Attorney, Agent, or Firm*—Fleit, Jacobson Cohn & Price

[57] ABSTRACT

A smoothing machine for wood panels, particularly wood panels having contoured surfaces with parts in relief, includes a substantially horizontal conveyor belt, a support structure overlying the belt, and a plurality of smoothing units carried by the structure. Each smoothing unit comprises a support frame and an abrasive roller rotatably supported by the frame and driven by a motor mounted on the frame, the rollers facing the belt and having coplanar horizontal axes of rotation. In the machine, each of the frames is pivoted about a vertical pivot axis on a motor-driven rotor rotatably supported about a vertical axis of rotation by the support structure, and the frames are releasably fixed to the rotor. The machine enables multi-directional smoothing whereby it is possible to smooth even very irregular panels.

6 Claims, 4 Drawing Figures

SMOOTHING MACHINE FOR WOOD PANELS

FIELD OF THE INVENTION

The present invention relates to a smoothing machine for wood panels, particularly wood panels having contoured surfaces with parts in relief or embossed, including a substantially horizontal conveyor belt, a support structure overlying the belt, and a plurality of smoothing units carried by the structure, each comprising a support frame, and an abrasive roller rotatably supported by the frame and driven by a motor mounted on the frame, the abrasive rollers facing the belt and having coplanar horizontal axes of rotation.

DESCRIPTION OF THE RELATED ART

In the field of wood panels, particularly for doors, new stylistic requirements are always becoming established, which are characterised by very irregular surfaces with parts which are markedly in relief and embossed.

The smoothing of these panels industrially is particularly difficult. Indeed, because of the presence of projections, the smoothing obtainable with the usual smoothing machines is not very satisfactory, especially in the more recessed zones which are difficult for the abrasive material to reach. If it is desired to achieve good quality smoothing, it is necessary to use hand tools with the inevitable increase in costs which ensues.

SUMMARY OF THE INVENTION

The object of the present invention is to provide a smoothing machine which completely solves the problem of working even panels with contoured surfaces.

According to the present invention, this object is achieved by a machine of the aforesaid type, characterised in that each of the frames is pivoted about a vertical pivot axis on a motor-driven rotor supported rotatably by the structure about a vertical axis of rotation, means being provided for releasably fixing the frames to the rotor.

Further characteristics and advantages of the machine according to the invention will become more apparent from the following description of a preferred embodiment.

DESCRIPTION OF THE PREFERRED EMBODIMENTS

Figure 1:
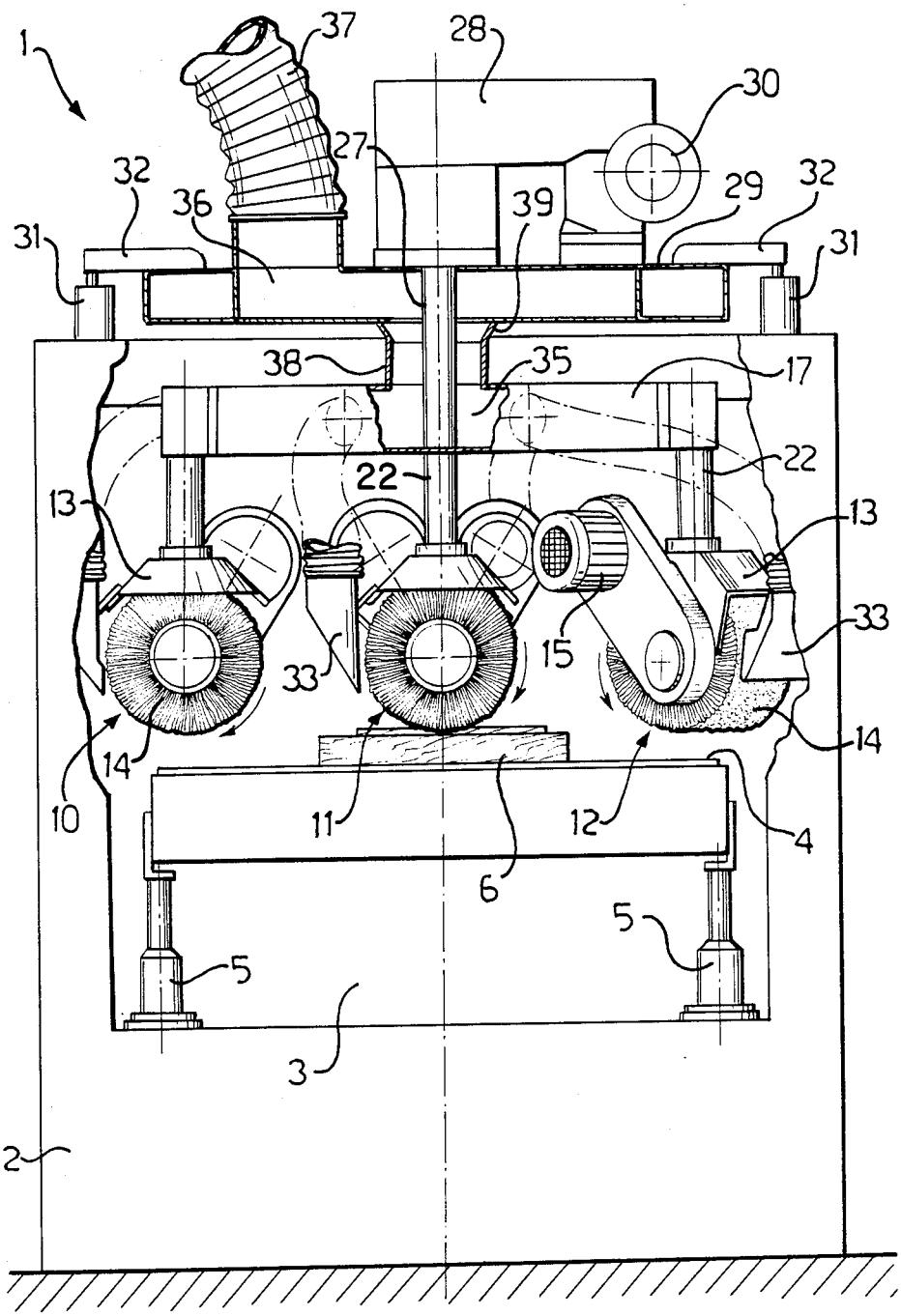
FIG. 1 is a frontal view of a machine according to the invention.
Figure 2:
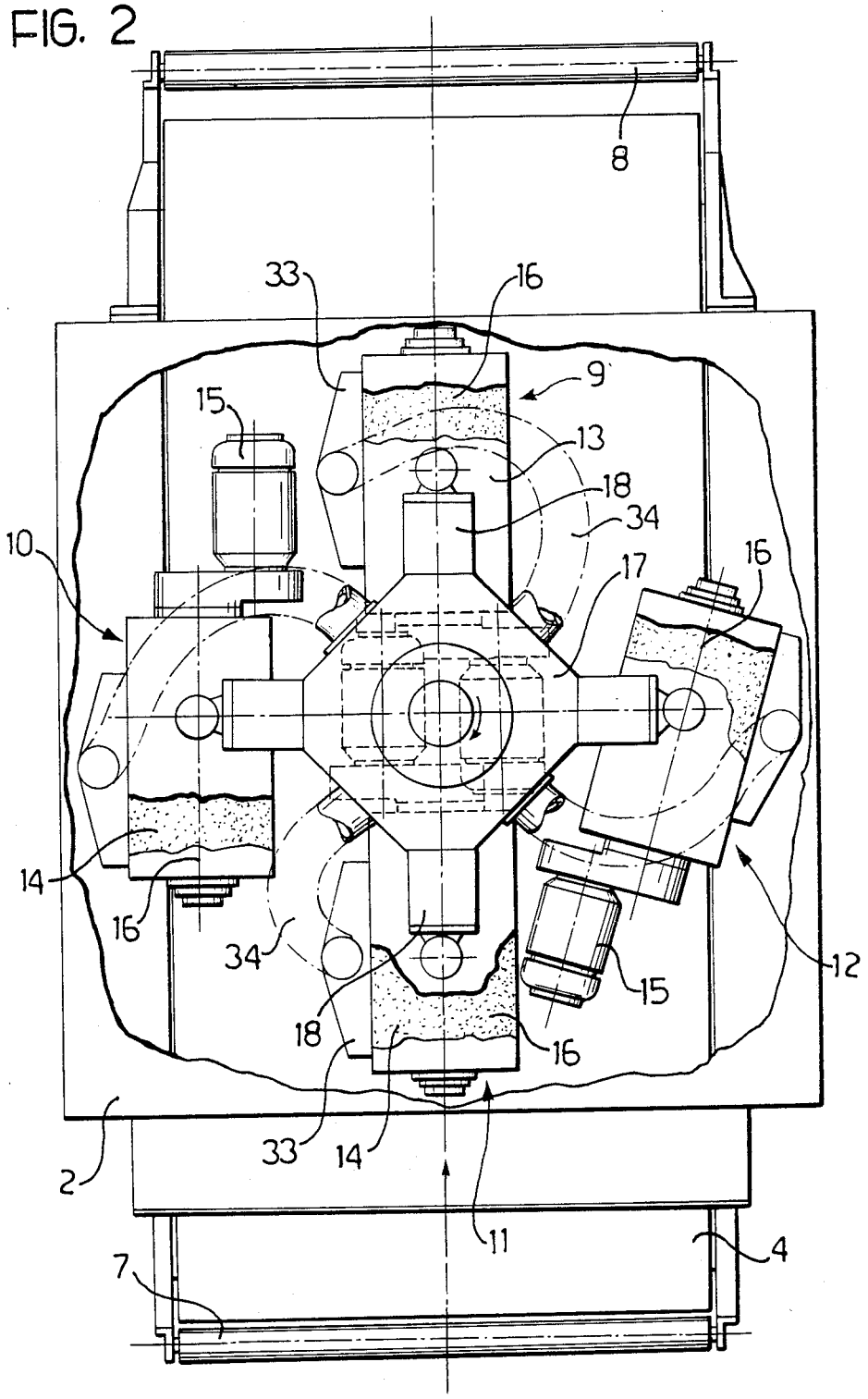
FIGS. 2 and 3 are plan views of the machine of FIG. 1 in two different positions of operation.
Figure 3:
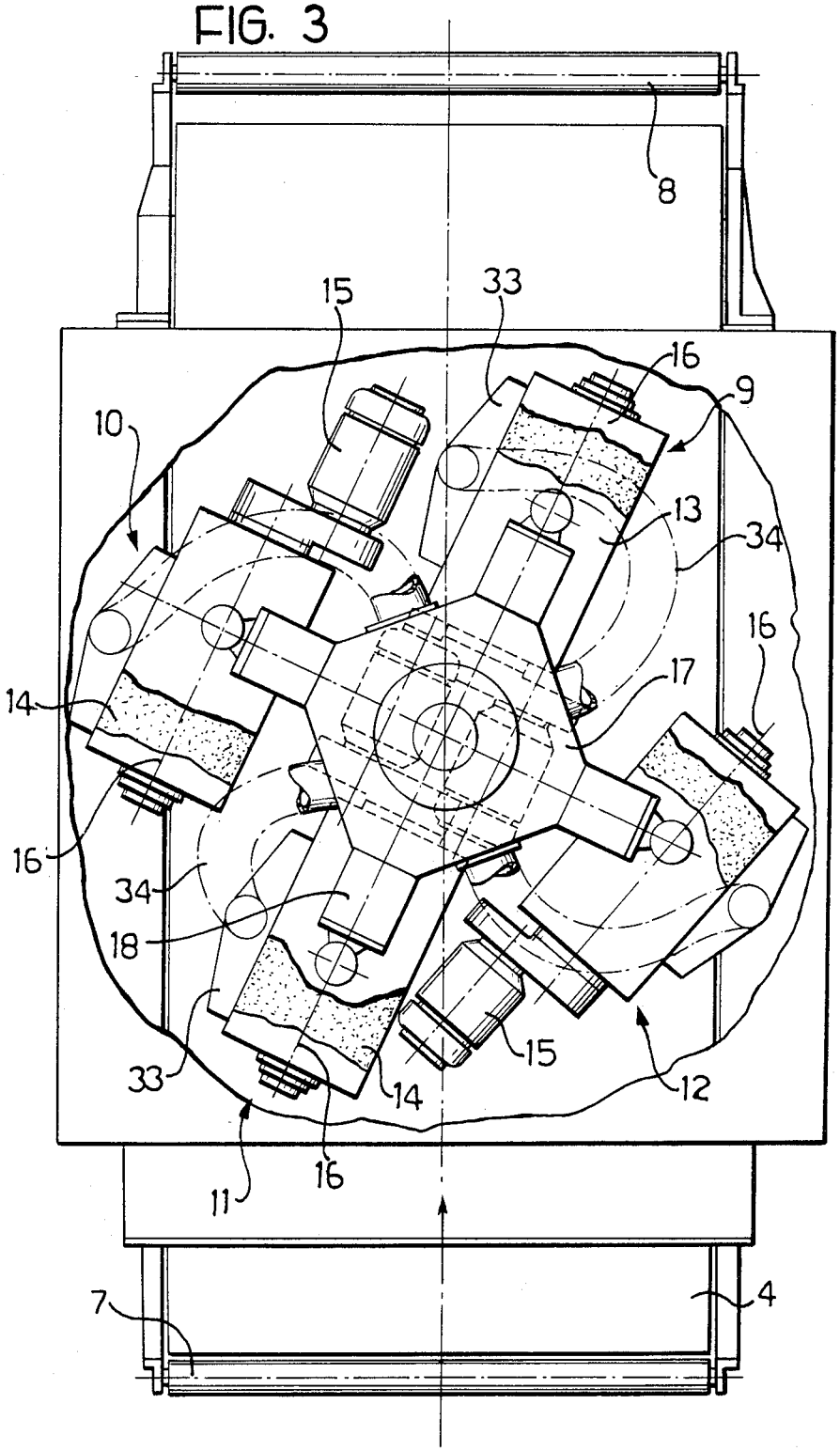
Figure 4:
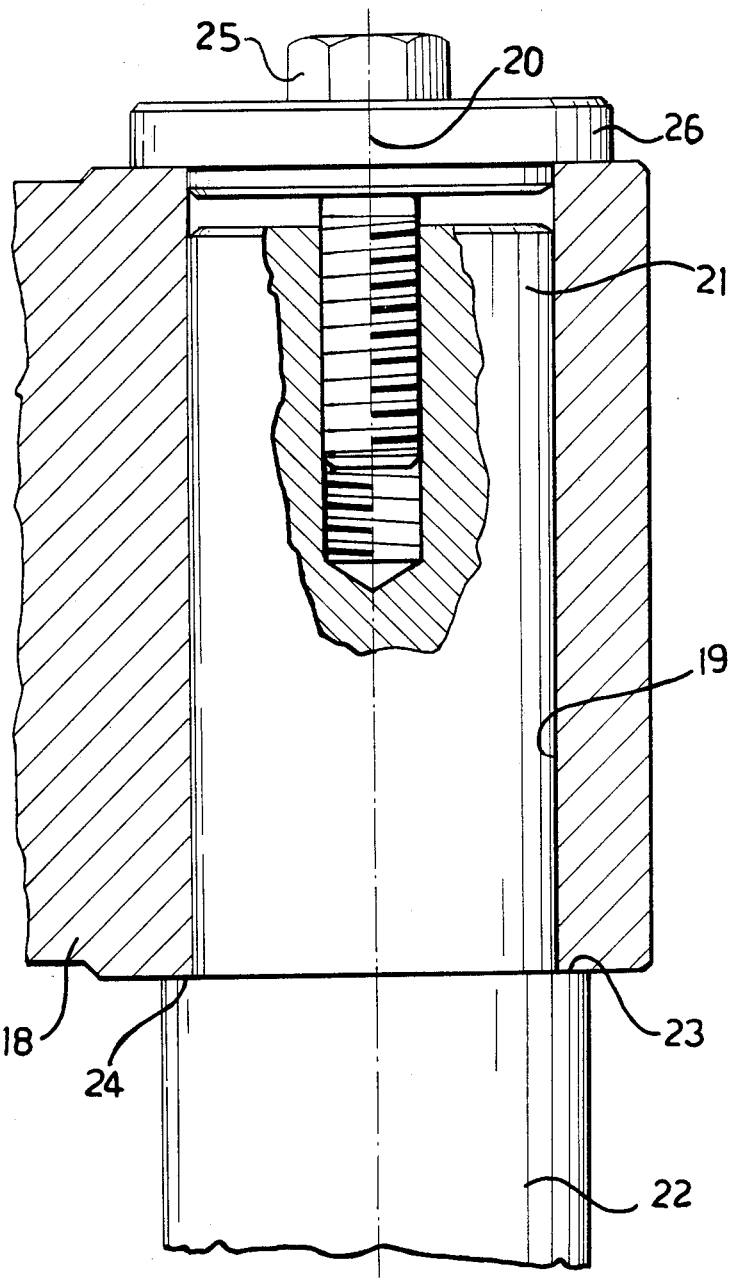
FIG. 4 is a sectional view of a detail of the machine of FIG. 1.

With reference to the drawings, a smoothing machine is generally indicated in FIG. 1.

The machine 1 includes a portal-type support structure 2 having a through opening 3.

A conveyor belt 4 passes through the opening 3 and is supported in a horizontal position by the structure 2 by means of jacks 5 which are adjustable in height. The belt 4 supports and drives a panel 6 to be smoothed, the panel being held on the belt 4 itself by conventional means, not shown. At the beginning and end of the belt 4 there are two respective support rollers 7, 8.

The structure 2 supports a plurality of smoothing units facing the belt 4; in particular, there are four units 9, 10, 11, 12.

The units 9, 10, 11, 12 each include respective frames, each indicated 13, and respective abrasive rollers, each indicated 14, and are each provided with respective motor units, each indicated 15, mounted on the frames 13, The abrasive rollers 14 have coplanar horizontal axes of rotation, indicated 16. The rollers 14 may be of different types, for example with blades or, to advantage, with flexible filaments of the type known commercially by the name TYNEX "A", made by the American company DUPONT.

The units 9, 10, 11, 12 are fixed separately and and adjustably to a single plate-shaped rotor 17. More particularly, the rotor 17 has radial arms 18 each of which is formed with a through hole 19 having a vertical axis 20. A tang 21 formed at the end of a pin 22 rigid with a respective frame 13 is engaged in each hole 19. Removable means are provided for preventing the pins 22 from rotating about the axes 20; for each pin 22, these means comprise two mating abutment seats 23, 24 formed on the pin 22 and the arm 18 respectively, and a screw 25 having a washer 26. The screw 25 is screwed axially into the tang 21 and the washer 26 bears on the arm 18 to force the abutment seats 23 and 24 against each other.

The rotor 17 has a shaft 27 with a vertical axis 28, whereby the rotor 17 is rotatably supported by a platform 29. Moreover, the shaft 27 is kinematically connected in an entirely conventional mannner to a geared motor unit 30 also supported by the platform 29.

The vertical position of the platform 29 relative to the stucture 2 can be adjusted by means of jacks 31 supported by the structure 2 and acting on brackets 32 rigid with the platform 29.

The machine 1 is also fitted with an extraction system for the wood dust produced during smoothing. This system includes a plurality of hoods 33, one for each unit 9, 10, 11, 12. Each hood 33 has a respective flexible tube 34 fixed to the rotor 17 and communicating with a chamber 35 formed within the rotor 17 itself. The chamber 35 communicates with a further chamber 36 formed within the platform 29 and opening into an external discharge duct 37. Communication between the chambers 35 and 36 (which are in relative motion during operation of the machine 1) is achieved by means of a connector 38 located about the shaft 27 and coaxial therewith; the connector 38 is fixed to the rotor 17 and has a seal 39 sliding on the platform 29.

The operation of the machine 1 described above is explained below.

The panel 6 to be smoothed is placed on the belt 4 which moves and carries it through the opening 3 into the working zone. Here the panel 6 comes into contact with the abrasive rollers 14 and is smoothed. The individual abrasive elements, that is, for example, the filaments of TYNEX "A", have a dual rotary movement about the axis 16 and about the axis 28. By virtue of this dual movement, each point on the panel 6 is smoothed by all four rollers 14.

The smoothing units 9, 10, 11, 12 with their respective abrasive rollers 14 can be oriented by varying the angular position of the pins 22 relative to the rotor 17. In order to do this, it is necessary to slacken the screw 25, move the pin 22 angularly until the axis 16 of the roller 14 has reached the desired position, and then retighten the screw 25. In the drawings, the axes 16 of the units 9 and 11 are radial to the rotor 17, the axis 16 of the unit 10 is tangential, and the axis 16 of the unit 12 is oblique. Moreover, the sense of rotation of the rollers 14 may be selected at will.

By virtue of these adjustments, it is possible to work any point on the panel 6 in four different directions corresponding to the directions of the peripheral velocities of the abrasive filaments of the four rollers 14. With this multi-directional action, it is possible to smooth the most irregular panels perfectly, since the abrasive filaments are able to reach even the most recessed and concealed parts.

Further adjustments can also increase the versatility of the machine. The possibility of moving the rotor 17 vertically with the platform 29 allows the machine 1 to be adapted prefectly to different panels, the working pressure of the rollers 14 being determined in dependence on the conformation of the surface to be worked, and also allows compensation for wear of the rollers 14. The conveyor belt 4 is also adjustable in height due to the jacks 5, thus allowing the machine 1 to be adapted easily to panels of different thicknesses.

I claim:

1. A smoothing machine for wood panels, particularly but not exclusively wood panels having contoured surfaces with parts in relief, said smoothing machine comprising:

a substantially horizontal conveyor belt;

a support structure overlying said belt;

a plurality of smoothing units carried by said structure, each smoothing unit comprising a support frame, an abrasive roller rotatably supported by said frame, and a roller drive motor mounted on said frame, the rollers facing the belt and having coplanar horizontal axes of rotation;

a rotor supported by said support structure about a vertical axis of rotation;

means for releasably fixing said frames of said smoothing units to said rotor, wherein each of said frames are pivoted on said rotor about a vertical axis such that each of said rollers can act along a different, independently adjustable direction from one another; and a motor for driving said rotor, said rotor rotating along sai vertical axis while each of said rollers of said smoothing units rotate along said coplanar horizontal axis.

2. A machine as defined in claim 1, wherein said rotor is essentially plate-shaped and has a plurality of radial arms each defining a hole, and wherein each frame has a pin which is engaged in a respective said hole to pivot said frame on said respective arm.

3. A machine as defined in claim 2, wherein said means for releasably fixing said frames to said rotor comprise, for each smoothing unit, two mating abutment seats on said pin and said arm respectively, and releasable means for forcing said seats against each other.

4. A machine as defined in claim 2, further including a platform for supporting said rotor on said support structure, and jacks for vertically positioning said platform on said support structure.

5. A machine according to claim 4, further including a dust extraction system comprising:

a respective hood for each smoothing unit;

a respective flexible tube connected to each hood, a first chamber defined within said rotor and communicating with said flexible tubes;

a second chamber defined within said platform and communicating with said first chamber;

a connector fixed coaxially to said rotor to allow communication between said chambers, and having a seal sliding on said platform, and an external discharge duct opening from said second chamber.

6. A machine as defined in claim 1, wherein said abrasive rollers are of the type having flexible filaments of the kind known commercially as TYNEX "A", made by DUPONT.

* * * * *